US012677879B2

(12) United States Patent
Benning et al.

(10) Patent No.: US 12,677,879 B2
(45) Date of Patent: Jul. 14, 2026

(54) ELECTRONIC AEROSOL PROVISION SYSTEM

(71) Applicant: Nicoventures Trading Limited, London (GB)

(72) Inventors: Jocelyn Benning, London (GB); Kelly Rees, London (GB); Walid Abi Aoun, London (GB)

(73) Assignee: Nicoventures Trading Limited, London (GB)

( * ) Notice: Subject to any disclaimer, the term of this patent is extended or adjusted under 35 U.S.C. 154(b) by 253 days.

(21) Appl. No.: 17/756,504

(22) PCT Filed: Nov. 27, 2020

(86) PCT No.: PCT/EP2020/083800
§ 371 (c)(1),
(2) Date: May 26, 2022

(87) PCT Pub. No.: WO2021/105478
PCT Pub. Date: Jun. 3, 2021

(65) Prior Publication Data

US 2023/0000162 A1 Jan. 5, 2023

(30) Foreign Application Priority Data

Nov. 29, 2019 (GB) ..... 1917474

(51) Int. Cl.
*A24F 40/465* (2020.01)
*A24F 40/30* (2020.01)
*A24F 40/57* (2020.01)

(52) U.S. Cl.
CPC ..... *A24F 40/465* (2020.01); *A24F 40/30* (2020.01); *A24F 40/57* (2020.01)

(58) Field of Classification Search
CPC ..... A24F 40/465; A24F 40/57; A24F 40/30
(Continued)

(56) References Cited

U.S. PATENT DOCUMENTS

2014/0069424 A1 3/2014 Poston et al.
2014/0270726 A1* 9/2014 Egoyants ..... H05B 3/44 392/386
(Continued)

FOREIGN PATENT DOCUMENTS

CN 103826482 5/2014
CN 105939625 9/2016
(Continued)

OTHER PUBLICATIONS

International Search Report and Written Opinion for Application No. PCT/EP2020/083800, mailed on Mar. 1, 2021, 13 pages.
(Continued)

*Primary Examiner* — Gary F Paumen
(74) *Attorney, Agent, or Firm* — MERCHANT & GOULD P.C.

(57) ABSTRACT

An aerosol provision device for generating aerosol from an aerosol generating material is disclosed. The device comprises at least one heating element arranged so as to be adjacent aerosol generating material when the aerosol generating material is present in the aerosol provision device. The heating element has a surface arranged to increase in temperature when supplied with energy and the surface defines an area of no greater than 130 $mm^2$ or 145 $mm^2$. Also described is an aerosol provision system, and a method for generating aerosol.

16 Claims, 6 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2016/0345630 | A1* | 12/2016 | Mironov | A61M 11/042 |
| 2017/0095006 | A1* | 4/2017 | Egoyants | F16L 59/065 |
| 2018/0271153 | A1 | 9/2018 | John et al. | |
| 2019/0208827 | A1 | 7/2019 | Mironov et al. | |
| 2020/0000148 | A1* | 1/2020 | Horrod | H05B 6/1254 |
| 2021/0037886 | A1* | 2/2021 | Mironov | A24F 40/44 |

FOREIGN PATENT DOCUMENTS

| | | | |
|---|---|---|---|
| EA | 201290392 | | 10/2012 |
| EA | 201290392 | A1 | 10/2012 |
| EP | 2454956 | | 5/2012 |
| EP | 2454956 | A1 | 5/2012 |
| EP | 3033954 | A1 | 6/2016 |
| EP | 3571941 | | 11/2019 |
| EP | 3571941 | A1 | 11/2019 |
| GB | 2570162 | | 7/2019 |
| GB | 2570162 | A | 7/2019 |
| JP | H3192677 | A | 8/1991 |
| JP | H03192677 | A | 8/1991 |
| JP | 2014520542 | A | 8/2014 |
| JP | 2018504127 | A | 2/2018 |
| JP | 2019517779 | A | 6/2019 |
| KR | 101927135 | | 12/2018 |
| KR | 101927135 | B1 | 12/2018 |
| RU | 2702425 | | 10/2019 |
| RU | 2702425 | C2 | 10/2019 |
| RU | 2704890 | | 10/2019 |
| RU | 2704890 | C2 | 10/2019 |
| WO | 2015117704 | | 8/2015 |
| WO | 2015117704 | A1 | 8/2015 |
| WO | WO-2018134159 | A1 | 7/2018 |

OTHER PUBLICATIONS

PCT International Preliminary Report on Patentability for PCT Patent Application No. PCT/EP2020/083800, mailed on Jun. 9, 2022, 10 pages.

RU Office Action received for Russian Application No. 2022114308, mailed on May 29, 2024, 20 Pages (with English Translation).

International Preliminary Report on Patentability for PCT Patent Application No. PCT/EP2020/083800, mailed on Jun. 9, 2022 10 pages.

Office Action received for Russian Application No. 2022114308, mailed on May 29, 2024 20 pages (10 pages of English Translation and 10 pages of Official Copy).

Chinese Office Action for Application No. 2020800826087, dated Apr. 29, 2026, 22 pages (6 pages English Translation, 16 pages Official).

* cited by examiner

ELECTRONIC AEROSOL PROVISION SYSTEM

PRIORITY CLAIM

The present application is a National Phase entry of PCT Application No. PCT/EP2020/083800, filed Nov. 27, 2020, which claims priority to Great Britain Application No. 1917474.7, filed Nov. 29, 2019, each of which is hereby fully incorporated herein by reference.

TECHNICAL FIELD

The present disclosure relates to non-combustible aerosol provision systems.

BACKGROUND

Electronic aerosol provision systems such as electronic cigarettes (e-cigarettes) generally contain a reservoir of a source liquid containing a formulation, typically including nicotine, from which an aerosol is generated, e.g. through heat vaporization. An aerosol source for an aerosol provision system may thus comprise a heater having a heating element arranged to receive source liquid from the reservoir, for example through wicking/capillary action. While a user inhales on the device, electrical power is supplied to the heating element to vaporize source liquid in the vicinity of the heating element to generate an aerosol for inhalation by the user. Such devices are usually provided with one or more air inlet holes located away from a mouthpiece end of the system. When a user sucks on a mouthpiece connected to the mouthpiece end of the system, air is drawn in through the inlet holes and past the aerosol source. There is a flow path connecting between the aerosol source and an opening in the mouthpiece so that air drawn past the aerosol source continues along the flow path to the mouthpiece opening, carrying some of the aerosol from the aerosol source with it. The aerosol-carrying air exits the aerosol provision system through the mouthpiece opening for inhalation by the user.

Other aerosol provision devices generate aerosol from a solid material, such as tobacco or a tobacco derivative. Such devices operate in a broadly similar manner to the liquid-based systems described above, in that the solid tobacco material is heated to a vaporization temperature to generate an aerosol which is subsequently inhaled by a user.

When heating a material to generate aerosol, several factors may determine the efficiency of heating and delivery of aerosol to a user.

Various approaches are described which seek to help address some of these issues.

SUMMARY

According to a first aspect of certain embodiments there is provided an aerosol provision device for generating aerosol from an aerosol generating material, the device comprising: at least one heating element arranged so as to be adjacent aerosol generating material when the aerosol generating material is present in the aerosol provision device, wherein the heating element has a surface arranged to increase in temperature when supplied with energy, the surface defining an area of no greater than 145 $mm^2$.

According to a second aspect of certain embodiments there is provided an aerosol provision system for generating aerosol from an aerosol generating material, the system comprising: aerosol generating material; and at least one heating element arranged so as to be adjacent aerosol generating material, wherein the heating element has a surface arranged to increase in temperature when supplied with energy, the surface defining an area of no greater than 130 $mm^2$ or 145 $mm^2$.

According to a third aspect of certain embodiments there is provided a method of generating aerosol from an aerosol generating material, the method comprising: placing aerosol generating material in proximity of a heating element, and heating the heating element to cause generation of aerosol from the aerosol generating material, wherein the heating element has a surface arranged to increase in temperature when supplied with energy, the surface defining an area of no greater than 130 $mm^2$ or 145 $mm^2$.

According to a fourth aspect of certain embodiments there is provided an aerosol provision device for generating aerosol from an aerosol generating material, the device comprising: at least one heating means arranged so as to be adjacent aerosol generating material when the aerosol generating material is present in the aerosol provision device, wherein the heating means has a surface arranged to increase in temperature when supplied with energy, the surface defining an area of no greater than 130 $mm^2$ or 145 $mm^2$.

According to a fifth aspect of certain embodiments there is provided an aerosol provision device for generating aerosol from an aerosol generating material, the device comprising: at least one first heating element arranged so as to be adjacent aerosol generating material when the aerosol generating material is present in the aerosol provision device, at least one second heating element arranged so as to be adjacent the at least one first heating element, wherein the first heating element comprises a first surface arranged to increase in temperature supplied with energy, wherein the second heating element comprises a second surface, and wherein at least one of the first surface and the second surface defines an area of no greater than 130 $mm^2$ or 145 $mm^2$.

It will be appreciated that features and aspects of the invention described above in relation to the first and other aspects of the invention are equally applicable to, and may be combined with, embodiments of the invention according to other aspects of the invention as appropriate, and not just in the specific combinations described above.

BRIEF DESCRIPTION OF THE DRAWINGS

Embodiments of the invention will now be described, by way of example only, with reference to the accompanying drawings, in which.

DETAILED DESCRIPTION

Figure 1:
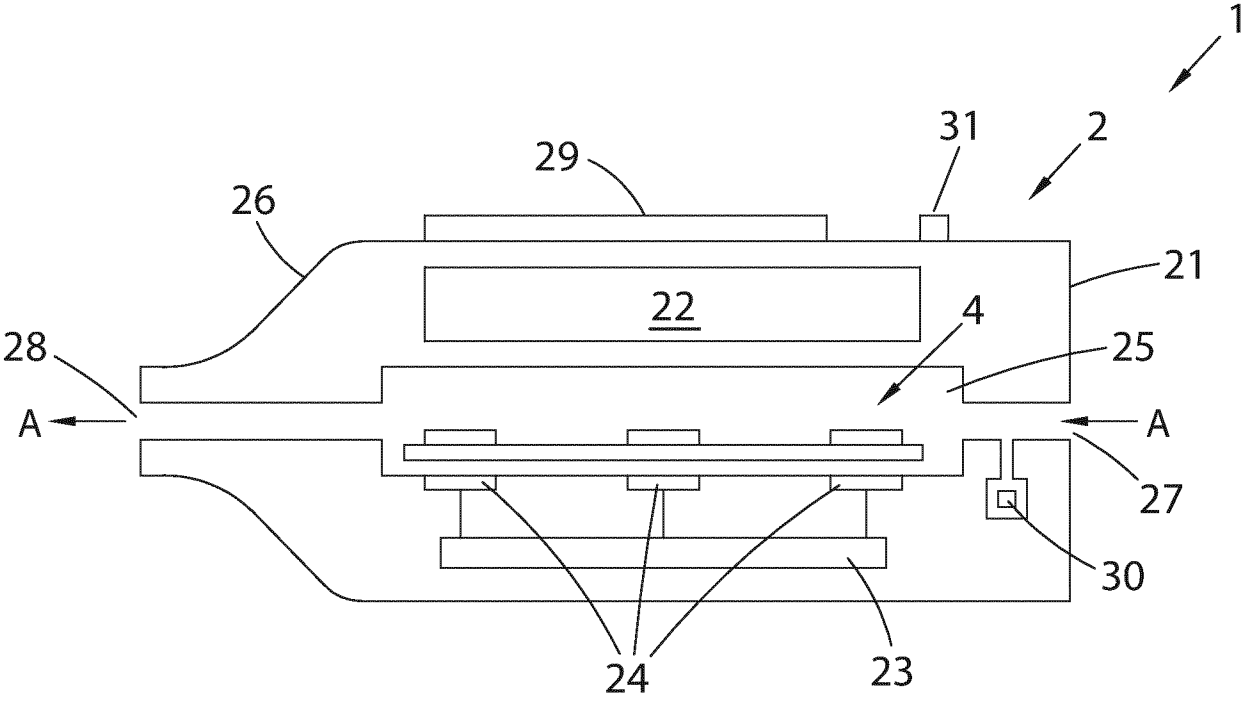
FIG. 1 is a cross-sectional view of a schematic representation of an aerosol provision system comprising an aerosol provision device and an aerosol generating article, the device comprising a plurality of heating elements and the article comprising a plurality of portions of aerosol generating material.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of examples and embodiments discussed herein which are not described in detail may be implemented in accordance with any conventional techniques for implementing such aspects and features.

The present disclosure relates to a "non-combustible" aerosol provision system. A "non-combustible" aerosol provision system is one where a constituent aerosolizable material of the aerosol provision system (or component thereof) is not combusted or burned in order to facilitate delivery of an aerosol to a user. Furthermore, and as is common in the technical field, the terms "vapor" and "aerosol", and related terms such as "vaporize", "volatilize" and "aerosolize", may generally be used interchangeably.

In some implementations, the non-combustible aerosol provision system is an electronic cigarette, also known as a vaping device or electronic nicotine delivery system (END), although it is noted that the presence of nicotine in the aerosolizable material is not a requirement. Throughout the following description the terms "e-cigarette" or "electronic cigarette" are sometimes used but these terms may be used interchangeably with aerosol (vapor) provision system.

Typically, the non-combustible aerosol provision system may comprise a non-combustible aerosol provision device and an article (sometimes referred to as a consumable) for use with the non-combustible aerosol provision device. However, it is envisaged that articles which themselves comprise a means for powering an aerosol generating component may themselves form the non-combustible aerosol provision system.

The article, part or all of which, is intended to be consumed during use by a user. The article may comprise or consist of aerosolizable material (also referred to as an aerosol generating material). The article may comprise one or more other elements, such as a filter or an aerosol modifying substance (e.g. a component to add a flavor to, or otherwise alter the properties of, an aerosol that passes through or over the aerosol modifying substance).

Non-combustible aerosol provision systems often, though not always, comprise a modular assembly including both a reusable aerosol provision device and a replaceable article. In some implementations, the non-combustible aerosol provision device may comprise a power source and a controller (or control circuitry). The power source may, for example, be an electric power source, such as a battery or rechargeable battery. In some implementations, the non-combustible aerosol provision device may also comprise an aerosol generating component. However, in other implementations the article may comprise partially, or entirely, or consist of, the aerosol generating component.

In some implementations, the aerosol generating component is a heater capable of interacting with the aerosolizable material so as to release one or more volatiles from the aerosolizable material to form an aerosol. The heater (or a heating element) may comprise one or more electrically resistive heaters, including for example one or more nichrome resistive heater(s) and/or one or more ceramic heater(s). The one or more heaters may comprise one or more induction heaters which includes an arrangement comprising one or more susceptors which may form a chamber into which an article comprising aerosolizable material is inserted or otherwise located in use. Alternatively or in addition, one or more susceptors may be provided in the aerosolizable material. Other heating arrangements may also be used.

The article for use with the non-combustible aerosol provision device generally comprises an aerosolizable material. Aerosolizable material, which also may be referred to herein as aerosol generating material, is material that is capable of generating aerosol, for example when heated, irradiated or energized in any other way. Aerosolizable material may, for example, be in the form of a solid, liquid or gel which may or may not contain nicotine and/or flavorants.

In the following disclosure, the aerosolizable material is described as comprising an "amorphous solid", which may alternatively be referred to as a "monolithic solid" (i.e. non-fibrous). In some implementations, the amorphous solid may be a dried gel. The amorphous solid is a solid material that may retain some fluid, such as liquid, within it. In some implementations, the aerosolizable material may for example comprise from about 50 wt %, 60 wt % or 70 wt % of amorphous solid, to about 90 wt %, 95 wt % or 100 wt % of amorphous solid. However, it should be appreciated that principles of the present disclosure may be applied to other aerosolizable materials, such as tobacco, reconstituted tobacco, a liquid, such as an e-liquid, etc.

As appropriate, the aerosolizable material or amorphous solid may comprise any one or more of: an active constituent, a carrier constituent, a flavor, and one or more other functional constituents.

The active constituent as used herein may be a physiologically active material, which is a material intended to achieve or enhance a physiological response. The active constituent may for example be selected from nutraceuticals, nootropics, and psychoactives. The active constituent may be naturally occurring or synthetically obtained. The active constituent may comprise for example nicotine, caffeine, taurine, theine, vitamins such as B6 or B12 or C, melatonin, cannabinoids, or constituents, derivatives, or combinations thereof. The active constituent may comprise one or more constituents, derivatives or extracts of tobacco, *cannabis* or another botanical. As noted herein, the active constituent may comprise one or more constituents, derivatives or extracts of *cannabis*, such as one or more cannabinoids or terpenes.

In some embodiments, the active constituent comprises nicotine. In some embodiments, the active constituent comprises caffeine, melatonin or vitamin B12.

In some embodiments, the aerosol-generating material comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT). The aerosol-generating material may comprise one or more cannabinoid compounds selected from the group consisting of cannabidiol (CBD) and THC (tetrahydrocannabinol). The aerosol-generating material may comprise cannabidiol (CBD). The aerosol-generating material may comprise nicotine and cannabidiol (CBD).

As noted herein, the active constituent may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Exemplary botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha* arventis, *Mentha* c.v., *Mentha* niliaca, *Mentha* piperita, *Mentha piperita citrata* c.v., *Mentha piperita* c.v, *Mentha spicata crispa, Mentha* cardifolia, *Mentha longifolia, Mentha suaveolens variegata, Mentha pulegium, Mentha spicata* c.v. and *Mentha suaveolens*

In some embodiments, the active constituent comprises or is derived from one or more botanicals or constituents, derivatives or extracts thereof and the botanical is tobacco.

In some embodiments, the active constituent comprises or derived from one or more botanicals or constituents, derivatives or extracts thereof and the botanical is selected from *eucalyptus*, star anise, cocoa and hemp.

In some embodiments, the active constituent comprises or derived from one or more botanicals or constituents, derivatives or extracts thereof and the botanical is selected from rooibos and fennel.

In some implementations, the aerosolizable material comprises a flavor (or flavorant).

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

The carrier constituent may comprise one or more constituents capable of forming an aerosol (e.g., an aerosol former). In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. In some embodiments, the aerosol former comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

The one or more other functional constituents may comprise one or more of pH regulators, coloring agents, preservatives, binders, fillers, stabilizers, and/or antioxidants.

The aerosolizable material may be present on or in a carrier support or carrier component) to form a substrate.

The carrier support may, for example, be or comprise paper, card, paperboard, cardboard, reconstituted aerosolizable material, a plastics material, a ceramic material, a composite material, glass, a metal, or a metal alloy.

In some implementations, the article for use with the non-combustible aerosol provision device may comprise aerosolizable material or an area for receiving aerosolizable material. In some implementations, the article for use with the non-combustible aerosol provision device may comprise a mouthpiece, or alternatively the non-combustible aerosol provision device may comprise a mouthpiece which communicates with the article. The area for receiving aerosolizable material may be a storage area for storing aerosolizable material. For example, the storage area may be a reservoir.

FIG. 1 is a cross-sectional view through a schematic representation of an aerosol provision system 1 in accordance with certain embodiments of the disclosure. The aerosol provision system 1 comprises two main components, namely an aerosol provision device 2 and an aerosol generating article 4.

The aerosol provision device 2 comprises an outer housing 21, a power source 22, control circuitry 23, a plurality of aerosol generating components 24, a receptacle 25, an inhalation or a mouthpiece end 26, an air inlet 27, an air outlet 28, a touch-sensitive panel 29, an inhalation sensor 30, and an indicator, e.g., an end of use indicator 31.

The outer housing 21 may be formed from any suitable material, for example a plastics material. The outer housing 21 is arranged such that the power source 22, control circuitry 23, aerosol generating components 24, receptacle 25 and inhalation sensor 30 are located within the outer housing 21. The outer housing 21 also defines the air inlet 27 and air outlet 28, described in more detail below. The touch sensitive panel 29 and end of use indicator 31 are located on the exterior of the outer housing 21.

The outer housing 21 may further include an inhalation or a mouthpiece end 26. The outer housing 21 and mouthpiece end 26 may be formed as a single component (that is, the mouthpiece end 26 may form a part of the outer housing 21). The inhalation or mouthpiece end 26 is defined as a region of the outer housing 21 which includes the air outlet 28 and may be shaped in such a way that a user may comfortably place their lips around the mouthpiece end 26 to engage with air outlet 28. In FIG. 1, the thickness of the outer housing 21 decreases towards the air outlet 28 to provide a relatively thinner portion of the aerosol provision device 2 which may be more easily accommodated by the lips of a user. In other implementations, however, the mouthpiece end 26 may be a removable component that is separate from, but able to be coupled to, the outer housing 21 and may be removed for cleaning and/or replacement with another mouthpiece end 26. The mouthpiece end 26 may, for example, be formed as part of the aerosol generating article 4.

The power source 22 is configured to provide operating power to the aerosol provision device 2. The power source 22 may be any suitable power source, such as a battery. For example, the power source 22 may comprise a rechargeable battery, such as a Lithium Ion battery. The power source 22 may be removable or form an integrated part of the aerosol provision device 2. In some implementations, the power source 22 may be recharged through connection of the device 2 to an external power supply (such as mains power) through an associated connection port, such as a USB port (not shown) or via a suitable wireless receiver (not shown).

The control circuitry 23 is suitably configured/programmed to control the operation of the aerosol provision device 2 to provide certain operating functions of aerosol provision device 2. The control circuitry 23 may be considered to logically comprise various sub-units/circuitry elements associated with different aspects of the operation of aerosol provision device 2. For example, the control circuitry 23 may comprise a logical sub-unit for controlling the recharging of the power source 22. Additionally, the control circuitry 23 may comprise a logical sub-unit for communication, e.g., to facilitate data transfer from or to the aerosol provision device 2. However, a primary function of the control circuitry 23 is to control the aerosolization of aerosol generating material, as described in more detail below. It will be appreciated the functionality of the control circuitry 23 can be provided in various different ways, for example using one or more suitably programmed programmable computer(s) and/or one or more suitably configured application-specific integrated circuit(s)/circuitry/chip(s)/chipset(s) configured to provide the desired functionality. The control circuitry 23 is connected to the power source 22 and receives power from the power source 22 and may be configured to distribute or control the power supply to other components of the aerosol provision device 2.

In the described implementation, the aerosol provision device 2 further comprises a receptacle 25 which is arranged to receive an aerosol generating article 4.

The aerosol generating article 4 comprises a carrier component 42 and aerosol generating material 44. The aerosol generating article 4 is shown in more detail in FIGS. 2A to 2C. FIG. 2A is a top-down view of the aerosol generating article 4, FIG. 2B is an end-on view along the width axis of the aerosol generating article 4, and FIG. 2C is a side-on view along the longitudinal (length) axis of the aerosol generating article 4.

The aerosol generating article 4 comprises a carrier component 42 which in this implementation is formed of card. The carrier component 42 forms the majority of the aerosol generating article 4, and acts as a base for the aerosol generating material 44 to be deposited on.

Figure 2B:
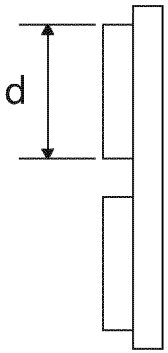
FIG. 2B is an end-on view along the longitudinal (length) axis of the aerosol generating article of FIG. 1.
Figure 2A:
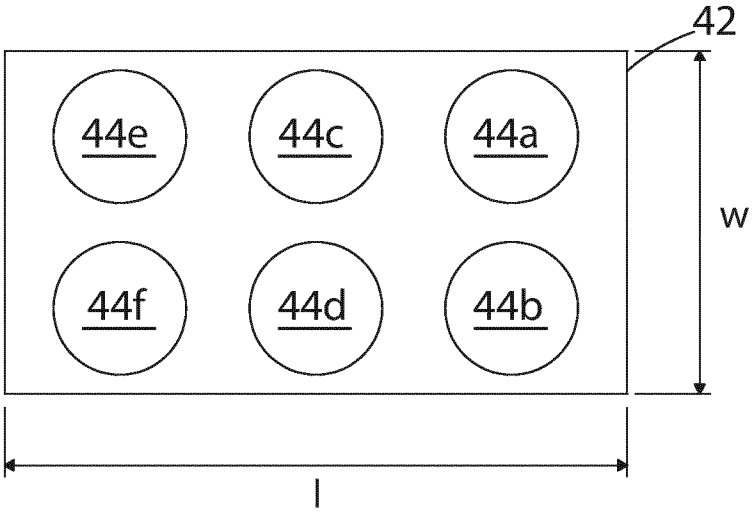
FIG. 2A is a top-down view of the aerosol generating article of FIG. 1.
Figure 2C:
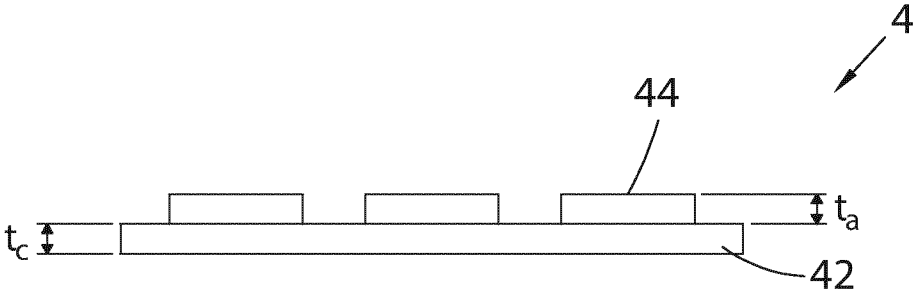
FIG. 2C is a side-on view along the width axis of the aerosol generating article of FIG. 1.

The carrier component 42 is broadly cuboidal in shape has a length 1, a width w and a thickness $t_c$ as shown in FIGS. 2A to 2C. By way of example, the length of the carrier component 42 may be 30 mm to 80 mm, the width may be 7 mm to 25 mm, and the thickness may be between 0.2 mm to 1 mm. However, it should be appreciated that the above are exemplary dimensions of the carrier component 42, and in other implementations the carrier component 42 may have different dimensions as appropriate. In some implementations, the carrier component 42 may comprise one or more protrusions extending in the length and/or width directions of the carrier component 42 to help facilitate handling of the aerosol generating article 4 by the user.

In the example shown in FIGS. 1 and 2, the aerosol generating article 4 comprises a plurality of discrete portions of aerosol generating material 44 disposed on a surface of the carrier component 42. More specifically, the article 4 comprises six discrete portions of aerosol generating material 44, labelled 44*a* to 44*f*, disposed in a two by three array. However, it should be appreciated that in other implementations a greater or lesser number of discrete portions may be provided, and/or the portions may be disposed in a different array (e.g., a one by six array). In the example shown, the aerosol generating material 44 is disposed at discrete, separate locations on a single surface of the carrier component 42. The discrete portions of aerosol generating material 44 are shown as having a circular footprint, although it should be appreciated that the discrete portions of aerosol generating material 44 may take any other footprint, such as square, triangular, hexagonal or rectangular, as appropriate. The discrete portions of aerosol generating material 44 have a diameter d and a thickness $t_a$ as shown in FIGS. 2A to 2C. The thickness $t_a$ may take any suitable value, for example the thickness $t_a$ may be in the range of 50 μm to 1.5 mm. In some embodiment, the thickness $t_a$ is from about 50 μm to about 200 μm, or about 50 μm to about 100 μm, or about 60 μm to about 90 μm, suitably about 77 μm. In other embodiments, the thickness $t_a$ may be greater than 200 μm, e.g., from about 50 μm to about 400 μm, or to about 1 mm, or to about 1.5 mm.

The discrete portions of aerosol generating material 44 are separated from one another such that each of the discrete portions may be energized (e.g., heated) individually/selectively to produce an aerosol. In some implementations, the portions of aerosol generating material 44 may have a mass no greater than 20 mg, such that the amount of material to be aerosolized by a given aerosol generating component 24 at any one time is relatively low. For example, the mass per portion may be equal to or lower than 20 mg, or equal to or lower than 10 mg, or equal to or lower than 5 mg. Of course, it should be appreciated that the total mass of the aerosol generating article 4 may be greater than 20 mg.

In the described implementation, the aerosol generating material 44 is an amorphous solid. Generally, the aerosol generating material 44 or amorphous solid may comprise a gelling agent (sometimes referred to as a binder) and an aerosol generating agent (which might comprise glycerol, for example). The gelling agent may comprise one or more compounds selected from cellulosic gelling agents, non-cellulosic gelling agents, guar gum, acacia gum and mixtures thereof. In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof. In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum. In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In preferred embodiments, the non-cellulose based gelling agent is alginate or agar.

The gelling agent may further comprise a setting agent (e.g., a calcium source). In certain implementations, the setting agent comprises or consists of calcium acetate, calcium formate, calcium carbonate, calcium hydrogencarbonate, calcium chloride, calcium lactate, or a combination thereof. In certain implementations, the setting agent comprises or consists of calcium formate and/or calcium lactate. In particular examples, the setting agent comprises or consists of calcium formate. The inventors have identified that, typically, employing calcium formate as a setting agent results in an amorphous solid having a greater tensile strength and greater resistance to elongation.

The aerosol generating material 44 or amorphous solid may comprise one or more of the following: an active substance (which may include a tobacco extract), a flavorant, an acid, and a filler. Other components may also be present as desired. In certain embodiments, the aerosol-generating material 44 or amorphous solid comprises a gelling agent comprising a cellulosic gelling agent and/or a non-cellulosic gelling agent, an active substance and an acid.

The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid. In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid. Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid. The inclusion of an acid is particularly preferred in embodiments in which the aerosol-generating material 44 comprises nicotine. In such embodiments, the presence of an acid may stabilize dissolved species in the slurry from which the aerosol-generating material 44 is formed. The presence of the acid may reduce or substantially prevent evaporation of nicotine during drying of the slurry, thereby reducing loss of nicotine during manufacturing.

The amorphous solid may comprise a colorant. The addition of a colorant may alter the visual appearance of the amorphous solid. The presence of colorant in the amorphous solid may enhance the visual appearance of the amorphous solid and the aerosol-generating material 44. By adding a colorant to the amorphous solid, the amorphous solid may be color-matched to other components of the aerosol-generating material 44 or to other components of an article comprising the amorphous solid.

A variety of colorants may be used depending on the desired color of the amorphous solid. The color of amorphous solid may be, for example, white, green, red, purple, blue, brown or black. Other color are also envisaged. Natural or synthetic colorants, such as natural or synthetic dyes, food-grade colorants and pharmaceutical-grade colorants may be used. In certain embodiments, the colorant is caramel, which may confer the amorphous solid with a brown appearance. In such embodiments, the color of the amorphous solid may be similar to the color of other components (such as tobacco material) in an aerosol-generating material 44 comprising the amorphous solid. In some embodiments, the addition of a colorant to the amorphous solid renders it visually indistinguishable from other components in the aerosol-generating material 44.

The colorant may be incorporated during the formation of the amorphous solid (e.g. when forming a slurry comprising the materials that form the amorphous solid) or it may be applied to the amorphous solid after its formation (e.g. by spraying it onto the amorphous solid).

An amorphous solid aerosolizable material offers some advantages over other types of aerosolizable materials commonly found in some electronic aerosol provision devices. For example, compared to electronic aerosol provision devices which aerosolize a liquid aerosolizable material, the potential for the amorphous solid to leak or otherwise flow from a location at which the amorphous solid is stored is greatly reduced. This means aerosol provision devices or articles may be more cheaply manufactured as the components do not necessarily require the same liquid-tight seals or the like to be used.

Compared to electronic aerosol provision devices which aerosolize a solid aerosolizable material, e.g., tobacco, a comparably lower mass of amorphous solid material can be aerosolized to generate an equivalent amount of aerosol (or to provide an equivalent amount of a constituent in the aerosol, e.g., nicotine). This is partially due to the fact that an amorphous solid can be tailored to not include unsuitable constituents that might be found in other solid aerosolizable materials (e.g., cellulosic material in tobacco, for example). For example, in some implementations, the mass per portion of amorphous solid is no greater than 20 mg, or no greater than 10 mg, or no greater than 5 mg. Accordingly, the aerosol provision device 2 can supply relatively less power to the aerosol generating article 4 and/or the aerosol generating article 4 can be comparably smaller to generate a similar aerosol, thus meaning the energy requirements for the aerosol provision device 2 may be reduced.

In some embodiments, the amorphous solid comprises tobacco extract. In these embodiments, the amorphous solid may have the following composition (by Dry Weight Basis, DWB): gelling agent (preferably comprising alginate) in an amount of from about 1 wt % to about 60 wt %, or about 10 wt % to 30 wt %, or about 15 wt % to about 25 wt %; tobacco extract in an amount of from about 10 wt % to about 60 wt %, or from about 40 wt % to 55 wt %, or from about 45 wt % to about 50 wt %; aerosol generating agent (preferably comprising glycerol) in an amount of from about 5 wt % to about 60 wt %, or from about 20 wt % to about 40 wt %, or from about 25 wt % to about 35 wt % (DWB). The tobacco extract may be from a single variety of tobacco or a blend of extracts from different varieties of tobacco. Such amorphous solids may be referred to as "tobacco amorphous solids", and may be designed to deliver a tobacco-like experience when aerosolized.

In one embodiment, the amorphous solid comprises about 20 wt % alginate gelling agent, about 48 wt % Virginia tobacco extract and about 32 wt % glycerol (DWB).

The amorphous solid of these embodiments may have any suitable water content. For example, the amorphous solid may have a water content of from about 5 wt % to about 15 wt %, or from about 7 wt % to about 13 wt %, or about 10 wt %.

Suitably, in any of these embodiments, the amorphous solid has a thickness $t_a$ of from about 50 μm to about 200 μm, or about 50 μm to about 100 μm, or about 60 μm to about 90 μm, suitably about 77 μm.

In some implementations, the amorphous solid may comprise 0.5-60 wt % of a gelling agent; and 5-80 wt % of an aerosol generating agent (DWB). Such amorphous solids may contain no flavor, no acid and no active substance. Such amorphous solids may be referred to as "aerosol generating agent rich" or "aerosol generating agent amorphous solids". More generally, this is an example of an aerosol generating agent rich aerosol generating material 44 which, as the name suggests, is a portion of aerosol generating material 44 which is designed to deliver aerosol generating agent when aerosolized.

In these implementations, the amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB).

In some other implementations, the amorphous solid may comprise 0.5-60 wt % of a gelling agent; 5-80 wt % of an aerosol generating agent; and 1-60 wt % of a flavor, (DWB). Such amorphous solids may contain flavor, but no active substance or acid. Such amorphous solids may be referred to as "flavorant rich" or "flavor amorphous solids". More generally, this is an example of a flavorant rich aerosol generating material 44 which, as the name suggests, is a portion of aerosol generating material 44 which is designed to deliver flavorant when aerosolized.

In these implementations, the amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB), flavor in an amount of from about 30 wt % to about 60 wt %, or from about 40 wt % to 55 wt %, or from about 45 wt % to about 50 wt %.

In some other implementations, the amorphous solid may comprise 0.5-60 wt % of a gelling agent; 5-80 wt % of an aerosol generating agent; and 5-60 wt % of at least one active substance (DWB). Such amorphous solids may contain an active substance, but no flavor or acid. Such amorphous solids may be referred to as "active substance rich" or "active substance amorphous solids". For example, in one implementation, the active substance may be nicotine, and as such an amorphous solid as described above comprising nicotine may be referred to as a "nicotine amorphous solid". More generally, this is an example of an active substance rich aerosol generating material which, as the name suggests, is a portion of aerosol generating material which is designed to deliver an active substance when aerosolized.

In these implementations, amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB), active substance in an amount of from about 30 wt % to about 60 wt %, or from about 40 wt % to 55 wt %, or from about 45 wt % to about 50 wt %.

In some other implementations, the amorphous solid may comprise 0.5-60 wt % of a gelling agent; 5-80 wt % of an aerosol generating agent; and 0.1-10 wt % of an acid (DWB). Such amorphous solids may contain acid, but no active substance and flavorant. Such amorphous solids may be referred to as "acid rich" or "acid amorphous solids". More generally, this is an example of an acid rich aerosol generating material which, as the name suggests, is a portion of aerosol generating material which is designed to deliver an acid when aerosolized.

In these implementations, the amorphous solid may have the following composition (DWB): gelling agent in an amount of from about 5 wt % to about 40 wt %, or about 10 wt % to 30 wt %, or about 15 wt % to about 25 wt %; aerosol generating agent in an amount of from about 10 wt % to about 50 wt %, or from about 20 wt % to about 40 wt %, or from about 25 wt % to about 35 wt % (DWB), acid in an amount of from about 0.1 wt % to about 8 wt %, or from about 0.5 wt % to 7 wt %, or from about 1 wt % to about 5 wt %, or form about 1 wt % to about 3 wt %.

The aerosol generating article 4 may comprise a plurality of portions of aerosol generating material 44 all formed form the same aerosol generating material (e.g., one of the amorphous solids described above). Alternatively, the article 4 may comprise a plurality of portions of aerosol generating material 44 where at least two portions are formed from different aerosol generating material (e.g., one of the amorphous solids described above).

The receptacle 25 is suitably sized to removably receive the aerosol generating article 4 therein. Although not shown, the aerosol provision device 2 may comprise a hinged door or removable part of the outer housing 21 to permit access to the receptacle 25 such that a user may insert and/or remove the aerosol generating article 4 from the receptacle 25. The hinged door or removable part of the outer housing 21 may also act to retain the aerosol generating article 4 within the receptacle 25 when closed. When the aerosol generating article 4 is exhausted or the user simply wishes to switch to a different aerosol generating article 4, the aerosol generating article 4 may be removed from the aerosol provision device 2 and a replacement aerosol generating article 4 positioned in the receptacle 25 in its place. Alternatively, the aerosol provision device 2 may include a permanent opening that communicates with the receptacle 25 and through which the aerosol generating article 4 can be inserted into the receptacle 25. In such implementations, a retaining mechanism for retaining the aerosol generating article 4 within the receptacle 25 of the aerosol provision device 2 may be provided.

As seen in FIG. 1, the device 2 comprises a number of aerosol generating components 24. In the described implementation, the aerosol generating components 24 are heating elements 24, and more specifically resistive heating elements 24. Resistive heating elements 24 receive an electrical current and convert the electrical energy into heat. The resistive heating elements 24 may be formed from, or comprise, any suitable resistive heating material, such as NiChrome (Ni20Cr80), which generates heat upon receiving an electrical current. In one implementation, the heating elements 24 may comprise an electrically insulating substrate on which resistive tracks are disposed.

Figure 3:
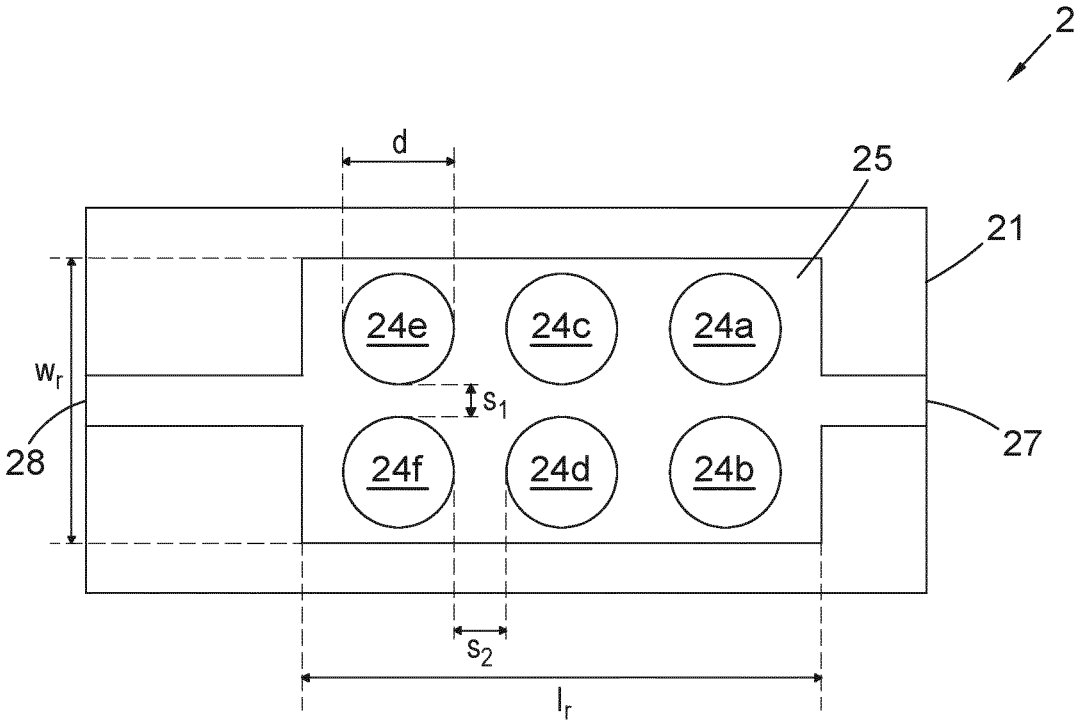
FIG. 3 is cross-sectional, top-down view of the heating elements of the aerosol provision device of FIG. 1.

FIG. 3 is a cross-sectional, top-down view of the aerosol provision device 2 showing the arrangement of the heating elements 24 in more detail. In FIGS. 1 and 3, the heating elements 24 are positioned such that a surface of a heating element 24 forms a part of the surface of the receptacle 25. That is, an outer surface of a heating element 24 is flush with the inner surface of the receptacle 25. More specifically, the outer surface of a heating element 24 that is flush with the inner surface of the receptacle 25 is a surface of heating element 24 that is heated (i.e., its temperature increases) when an electrical current is passed through the heating element 24.

In the present example, the heating element 24 is formed of an electrically-conductive plate, which defines the surface of the heating element 24 that is arranged to increase in temperature. The electrically-conductive plate may be formed of a metallic material, for example, NiChrome, which generates heat when a current is passed through the electrically-conductive plate. In other implementations, a separate electrically-conductive track may pass on a surface of, or through, a second material (e.g., a metal material or a ceramic material), with the electrically-conductive track generating heat that is transferred to the second material. That is, the second material in combination with the electrically-conductive track form the heating element 24. In the latter example, the surface of the heating element 24 that is arranged to increase in temperature is defined by the perimeter of the second material.

In the described implementation, the surfaces of the heating elements 24 that are arranged to increase in temperature are also planar and are generally located in a plane parallel to a wall of the receptacle 25. However, in other implementations, the surfaces may be curved; that is to say, the plane in which the surfaces of the heating elements 24 are located may have a radius of curvature in one axis (e.g., the surface may be approximately parabolic). The heating elements 24 are arranged such that, when the article 4 is received in the receptacle 25, each heating element 24 aligns with a corresponding discrete portion of aerosol generating material 44. Hence, in this example, six heating elements 24 are arranged in a two by three array broadly corresponding to the arrangement of the two by three array of the six discrete portions of aerosol generating material 44 shown in FIG. 2A. However, as discussed above, the number of heating elements 24 may be different in different implementations, for example there may be 8, 10, 12, 14, etc. heating elements 24. In some implementations, the number of heating elements 24 is greater than or equal to six but no greater than 20.

More specifically, the heating elements 24 are labelled 24*a* to 24*f* in FIG. 3, and it should be appreciated that each heating element 24 is arranged to align with a corresponding portion of aerosol generating material 44 as denoted by the corresponding letter following the references 24/44. Accordingly, each of the heating elements 24 can be individually activated to heat a corresponding portion of aerosol generating material 44. It is also contemplated that heating elements 24 may sequentially heat different portions of aerosol generating material 44. In such implementations (not shown) the heating element 24 and portions of aerosol generating material 44 may move relative to each other. For example, the aerosol generating article 4 may slide along, or revolve around, the receptacle 25. Alternatively, one or more heating elements 24 may be arranged to move with respect to the receptacle 25.

While the heating elements 24 are shown flush with the inner surface of the receptacle 25, in other implementations the heating elements 24 may protrude into the receptacle 25. In either case, the aerosol generating article 4 contacts the surfaces of the heating elements 24 when present in the receptacle 25 such that heat generated by the heating elements 24 is conducted to the aerosol generating material 44 through the carrier component 42.

In some implementations, to improve the heat-transfer efficiency, the receptacle may comprise components which apply a force to the surface of the carrier component 42 so as to press the carrier component 42 onto the heater elements 24, thereby increasing the efficiency of heat transfer via conduction to the aerosol generating material 44. Additionally or alternatively, the heater elements 24 may be configured to move in the direction towards/away from the aerosol generating article 4, and may be pressed into the surface of carrier component 42 that does not comprise the aerosol generating material 44.

In use, the aerosol provision device 2 (and more specifically the control circuitry 23) is configured to deliver power to the heating elements 24 in response to a user input. Broadly speaking, the control circuitry 23 is configured to selectively apply power to the heating elements 24 to subsequently heat the corresponding portions of aerosol generating material 44 to generate aerosol. When a user inhales on the aerosol provision device 2 (i.e., inhales at mouthpiece end 26), air is drawn into the aerosol provision device 2 through air inlet 27, into the receptacle 25 where it mixes with the aerosol generated by heating the aerosol generating material 44, and then to the user's mouth via air outlet 28. That is, the aerosol is delivered to the user through mouthpiece end 26 and air outlet 28.

The aerosol provision device 2 of FIG. 1 includes a touch-sensitive panel 29 and an inhalation sensor 30. Collectively, the touch-sensitive panel 29 and inhalation sensor 30 act as mechanisms for receiving a user input to cause the generation of aerosol, and thus may more broadly be referred to as user input mechanisms. The received user input may be said to be indicative of a user's desire to generate an aerosol.

The touch-sensitive panel 29 may be a capacitive touch sensor and can be operated by a user of the aerosol provision device 2 placing their finger or another suitably conductive object (for example a stylus) on the touch-sensitive panel 29. In the described implementation, the touch-sensitive panel 29 includes a region which can be pressed by a user to start aerosol generation. The control circuitry 23 may be configured to receive signaling from the touch-sensitive panel 29 and to use this signaling to determine if a user is pressing (i.e. activating) the region of the touch-sensitive panel 29. If the control circuitry 23 receives this signaling, then the control circuitry 23 is configured to supply power from the power source 22 to one or more of the heating elements 24. Power may be supplied for a predetermined time period (for example, three seconds) from the moment a touch is detected, or in response to the length of time the touch is detected for. In other implementations, the touch sensitive panel 29 may be replaced by a user actuatable button (not shown) or the like.

The inhalation sensor 30 may be a pressure sensor or microphone or the like configured to detect a drop in pressure or a flow of air caused by the user inhaling on the aerosol provision device 2. The inhalation sensor 30 is located in fluid communication with the air flow pathway (that is, in fluid communication with the air flow path between air inlet 27 and air outlet 28). In a similar manner as described above, the control circuitry 23 may be configured to receive signaling from the inhalation sensor 30 and to use this signaling to determine if a user is inhaling on the aerosol provision system 1. If the control circuitry 23 receives this signaling, then the control circuitry 23 is configured to supply power from the power source 22 to one or more of the heating elements 24. Power may be supplied for a predetermined time period (for example, three seconds) from the moment inhalation is detected, or in response to the length of time the inhalation is detected for.

In the described example, both the touch-sensitive panel 29 and inhalation sensor 30 detect the user's desire to begin generating aerosol for inhalation. The control circuitry 23 may be configured to only supply power to the heating element 24 when signaling from both the touch-sensitive panel 29 and inhalation sensor 30 are detected. This may help prevent inadvertent activation of the heating elements 24 from accidental activation of one of the user input mechanisms. However, in other implementations, the aerosol provision system 1 may have only one of a touch sensitive panel 29 and an inhalation sensor 30.

These aspects of the operation of the aerosol provision system 1 (i.e. puff detection and touch detection) may in themselves be performed in accordance with established techniques (for example using conventional inhalation sensor and inhalation sensor signal processing techniques and using conventional touch sensor and touch sensor signal processing techniques).

In some implementations, in response to detecting the signaling from either one or both of the touch-sensitive panel 29 and inhalation sensor 30, the control circuitry 23 is configured to sequentially supply power to each of the individual heating elements 24.

More specifically, the control circuitry 23 is configured to sequentially supply power to each of the individual heating elements 23 in response to a sequence of detections of the signaling received from either one or both of the touch-sensitive panel 29 and inhalation sensor 30. For example, the control circuitry 23 may be configured to supply power to a first heating element 24 of the plurality of heating elements 24 when the signaling is first detected (e.g., from when the aerosol provision device 2 is first switched on). When the signaling stops, or in response to the predetermined time from the signaling being detected elapsing, the control circuitry 23 registers that the first heating element 24 has been activated (and thus the corresponding discrete portion of aerosol generating material 44 has been heated). The control circuitry 23 determines that in response to receiving subsequent signaling from either one or both of the touch-sensitive panel 29 and inhalation sensor 30 that a second heating element 24 is to be activated. Accordingly, when the signaling from either one or both of the touch-sensitive panel 29 and inhalation sensor 30 is received by the control circuitry 23, the control circuitry 23 activates the second heating element 24. This process is repeated for remaining heating elements 24, such that all heating elements 24 are sequentially activated.

Effectively, this operation means that for each inhalation a different one of the discrete portions of aerosol generating material 44 is heated and an aerosol generated therefrom. In other words, a single discrete portion of aerosol generating material 44 is heated per user inhalation.

In other implementations, the control circuitry 23 may be configured to activate the first heating element 24 a plurality of times (e.g., two) before determining that the second heating element 24 should be activated in response to subsequent signaling from either one or both of the touch-sensitive panel 29 and inhalation sensor 30, or to activate each of the plurality of heating elements 24 once and when all heating elements 24 have be activated once, detection of subsequent signaling causes the heating elements 24 to be sequentially activated a second time.

Such sequential activations may be dubbed "a sequential activation mode", which is primarily designed to deliver a consistent aerosol per inhalation (which may be measured in terms of total aerosol generated, or a total constituent delivered, for example). Hence, this mode may be most effective when each portion of the aerosol generating material 44 of the aerosol generating article 4 is substantially identical; that is, portions 44*a* to 44*f* are formed of the same material.

In some other implementations, in response to detecting the signaling from either one or both of the touch-sensitive panel 29 and inhalation sensor 30, the control circuitry 23 is configured to supply power to one or more of the heating elements 24 simultaneously.

In such implementations, the control circuitry 23 may be configured to supply power to selected ones of the heating elements 24 in response to a predetermined configuration. The predetermined configuration may be a configuration selected or determined by a user. For example, the touch-sensitive panel 29 may comprise a region that permits the user to individually select which of the heating elements 24 to activate when signaling from either one or both of the touch-sensitive panel 29 and inhalation sensor 30 is received by the control circuitry 23. In some implementations, the user may also be able to set the power level to be supplied to each heating element 24 in response to receiving the signaling.

Figure 4:
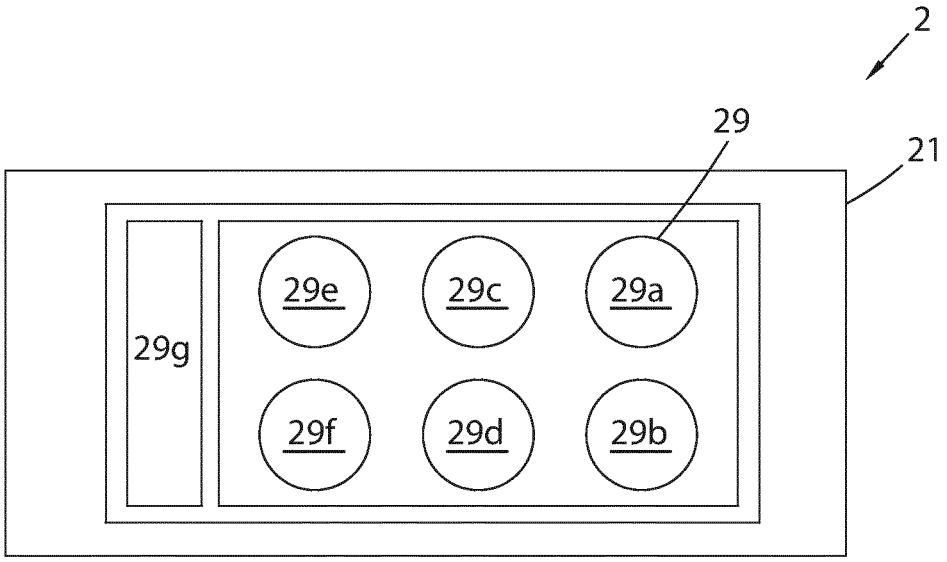
FIG. 4 is a top-down view of an exemplary touch sensitive panel for operating various functions of the aerosol provision system of FIG. 1.

FIG. 4 is a top-down view of the touch-sensitive panel 29 in accordance with such implementations. FIG. 4 schematically shows outer housing 21 and touch-sensitive panel 29 of aerosol provision device 2 as described previously. The touch-sensitive panel 29 comprises six regions 29*a* to 29*f* which correspond to each of the six heating elements 24, and a region 29*g* which corresponds to the region for indicating that a user wishes to start inhalation or generating aerosol as described previously. The six regions 29*a* to 29*f* each correspond to touch-sensitive regions which can be touched by a user to control the power delivery to each of the six corresponding heating elements 24. In the described implementation, each heating element 24 can have multiple states, e.g., an off state in which no power is supplied to the heating element 24, a low power state in which a first level of power is supplied to the heating element 24, and a high power state in which a second level of power is supplied to the heating element 24 where the second level of power is greater than the first level of power. However, in other implementations, fewer or greater states may be available to the heating elements 24. For example, each heating element 24 may have an off state in which no power is supplied to the heating element 24 and an on state in which power is supplied to the heating element 24.

Accordingly, a user can set which heating elements 24 (and subsequently which portions of aerosol generating material 44) are to be heated (and optionally to what extent they are to be heated) by interacting with the touch-sensitive panel 29 in advance of generating aerosol. For example, the user may repeatedly tap the regions 29*a* to 29*f* to cycle through the different states (e.g., off, low power, high power, off, etc.). Alternatively, the user may press and hold the region 29*a* to 29*f* to cycle through the different states, where the duration of the press determines the state.

The touch-sensitive panel 29 may be provided with one or more indicators for each of the respective regions 29*a* to 29*f* to indicate which state the corresponding heating element 24 is currently in. For example, the touch-sensitive panel may comprise one or more LEDs or similar illuminating elements, and the intensity of the LEDs signifies the current state of the corresponding heating element 24. Alternatively, a colored LED or similar illuminating element may be provided and the color indicates the current state. Alternatively, the touch-sensitive panel 29 may comprise a display element (e.g., which may underlie a transparent touch-sensitive panel 29 or be provided adjacent to the regions 29*a* to 29*f* of the touch-sensitive panel 29) which displays the current state of the corresponding heating element 24.

When the user has set the configuration for the heating elements 24, in response to detecting the signaling from either one or both of the touch-sensitive panel 29 (and more particularly region 29*g* of touch-sensitive panel 29) and inhalation sensor 30, the control circuitry 23 is configured to supply power to the selected heating elements 24 in accordance with the pre-set configuration.

Accordingly, such simultaneous heating element 24 activations may be dubbed "a simultaneous activation mode", which is primarily designed to deliver a customizable aerosol from a given aerosol generating article 4, with the intention of allowing a user to customize their experience on a session-by-session or even puff-by-puff basis. Hence, this mode may be most effective when portions of the aerosol generating material 44 of the aerosol generating article 4 are different from one another. For example, portions 44*a* and 44*b* are formed of one material, portions 44*c* and 44*d* are formed of a different material, etc. Accordingly, with this mode of operation, the user may select which portions of aerosol generating material 44 to aerosolize at any given moment and thus which combinations of aerosols to be provided with.

In both of the simultaneous and sequential activation modes, the control circuitry 23 may be configured to generate an alert signal which signifies the end of use of the aerosol generating article 4, for example when each of the heating elements 24 has been sequentially activated a predetermined number of times, or when a given heating element 24 has been activated a predetermined number of times and/or for a given cumulative activation time and/or with a given cumulative activation power. In FIG. 1, the aerosol provision device 2 includes an end of use indicator 31 which in this implementation is an LED. However, in other implementations, the end of use indicator 31 may comprise any mechanism which is capable of supplying an alert signal to a user; that is, the end of use indicator 31 may be an optical element to deliver an optical signal, a sound generator to deliver an aural signal, and/or a vibrator to deliver a haptic signal. In some implementations, the indicator 31 may be combined with or otherwise provided by the touch-sensitive panel 29 (e.g., if the touch-sensitive panel includes a display element). The aerosol provision device 2 may prevent subsequent activation of the aerosol provision device 2 when the alert signal is being output. The alert signal may be switched off, and the control circuitry 23 reset, when the user replaces the aerosol generating article 4 and/or switches off the alert signal via a manual means such as a button (not shown).

In more detail, in implementations where the sequential mode of activation is employed, the control circuitry 23 may be configured to count the number of times signaling from either one or both of the touch-sensitive panel 29 and inhalation sensor 30 is received during a period of usage, and once the count reaches a predetermined number, the aerosol generating article 4 is determined to have reached the end of its life. For example, for an aerosol generating article 4 comprising six discrete portions of aerosol generating material 44, the predetermined number may be six, twelve, eighteen, etc. depending on the exact implementation at hand.

In implementations where the simultaneous mode of activation is employed, the control circuitry 23 may be configured to count the number of times one or each of the discrete portions of aerosol generating material 44 is heated. For example, the control circuitry 23 may count how many times a nicotine containing portion is heated, and when that reaches a predetermined number, determine an end of life of the aerosol generating article 4. Alternatively, the control circuitry 23 may be configured to separately count for each discrete portion of aerosol generating material 44 when that portion has been heated. Each portion may be attributed with the same or a different predetermined number and when any one of the counts for each of the portions of aerosol generating material 44 reaches the predetermined number, the control circuitry 23 determines an end of life of the aerosol generating article 4.

In either of the implementations, the control circuitry 23 may also factor in the length of time the portion of aerosol generating material 44 has been heated for and/or the temperature to which the portion of the aerosol generating material 44 has been heated. In this regard, rather than counting discrete activations, the control circuitry 23 may be configured to calculate a cumulative parameter indicative of the heating conditions experienced by each of the portions of aerosol generating material 44. The parameter may be a cumulative time, for example, whereby the temperature to which the aerosol generating material 44 is heated is used to adjust the length of time added to the cumulative time. For example, a portion of aerosol generating material 44 heated at 200° C. for three seconds may contribute three seconds to the cumulative time, whereas a portion of aerosol generating material 44 heated at 250° C. for three seconds may contribute four and a half seconds to the cumulative time.

The above techniques for determining the end of life of the aerosol generating article 4 should not be understood as an exhaustive list of ways of determining the end of life of the aerosol generating article 4, and in fact any other suitable way may be employed in accordance with the principles of the present disclosure.

The described implementations are arranged so as to heat discrete portions of aerosol generating material 44 to generate a suitable aerosol for inhalation. An advantage of these systems is that they offer the ability to heat different portions of aerosol generating material 44 at different times during a session of use. For example, in the sequential mode of operation, portion 44*a* can be heated at a first time to deliver aerosol and portion 44*b* can be heated at a second time to deliver the same or a different aerosol.

However, because these systems offer flexibility in in terms of which portions of aerosol can be heated for any given inhalation, these systems ideally should be able to begin generating aerosol quickly in response to receiving a user's instruction to start generating aerosol. In part, this will depend upon the rate at which energy can be transferred from the heating element to the portion of aerosol generating material 44 to be heated, but also on the properties of the aerosol generating material 44 to be heated such as the mass, density, thickness, and constituents present in the aerosol generating material 44 to name but a few factors. For example, the thickness of the aerosol generating material 44 may be a significant factor in how quickly the aerosol generating material 44 can be heated and subsequently how long until the aerosol generating material 44 starts to generate an inhalable aerosol. Generally speaking, the thicker the aerosol generating material 44, the longer the time until an inhalable aerosol is generated (all other conditions being the same).

In addition, each portion of aerosol generating material 44 may be designed to deliver a certain quantity of aerosol when heated, for example, if a different discrete portion is heated per puff. In other words, the aerosol generating material 44 may have a certain mass in order to be able to generate a desired amount of aerosol when heated. Assuming a fixed thickness and a fixed density of the aerosol generating material 44, the areal extent of the aerosol generating material 44 is taken into account in order to provide the desired mass delivery. Put simply, assuming a fixed thickness and a fixed density, the greater the areal extent of the aerosol generating material 44 (and the greater the areal extent of a corresponding heating element 24), the greater the expected mass of aerosol generated from the aerosol generating material 44.

The above two factors are suggestive of rather large areal extents of the heating elements 24 and/or the portions of aerosol generating material 44 and relatively thin thicknesses of aerosol generating material 44 to provide quick aerosol generation times and sufficient quantities of aerosol. However, there is a tendency for aerosol provision systems to be miniaturized/handheld, so that the systems are portable. Devices which have a footprint much beyond the size a of palm of a human hand (e.g., 9 cm by 7 cm) start to become more difficult for a user to hold (particularly in one hand) and also tend to be more cumbersome and inconvenient to use during a session of inhaling aerosol. In the aerosol provision system 1 of FIGS. 1 to 3, a plurality of portions of aerosol generating material 44 are to be vaporized, e.g., six portions as shown, which means there are practical limitations on how great the areal extent of the portions of aerosol generating material 44 can be (which translates, from a device point of view, to limitations on the areal extent of the heating elements 24). A balance may be struck between the parameters in order to arrive at a system that delivers sufficient aerosol per portion, quickly, and does not have a large footprint.

The inventors have found that a good compromise exists when a surface of the heating element 24 that is arranged to increase in temperature during use defines an area (e.g., a superficial surface area) that is no greater than 130 $mm^2$ or 145 $mm^2$. A heating element 24 having a surface that defines an area no greater than 130 $mm^2$ or 145 $mm^2$ leads to a device which is able to aerosolize a plurality of different portions of aerosol generating material 44 while still having a relatively small overall footprint. A heating element 24 having a surface any greater than 130 $mm^2$ or 145 $mm^2$ and the device footprint tends to increase in size particularly when there are a plurality of heating elements, such as six or more, to an extent which is ergonomically undesirable (especially when considering the presence of outer housing 21, power source 22, and any thermal insulation (not shown) to prevent the outer housing 21 reaching unpleasant temperatures).

In some implementations, the surface of the heating element 24 defines an area that is no less than 10 $mm^2$. As mentioned, a number of factors may influence the aerosol that is generated from a portion of aerosol generating material 44. If the mass of aerosol to be delivered is considered to be an important quantity, then for a heating element 24 to have a surface which is less than 10 $mm^2$ will require a relatively thicker portion of aerosol generating material 44 to be heated to generate the same amount of aerosol. However, as mentioned, a thicker portion of aerosol generating material 44 takes longer to heat and generate aerosol, so the aerosol provision system 1 offers a poor responsiveness. One can adjust the responsiveness by increasing the rate of energy transfer (e.g., by heating the heating element 24 to a higher temperature), however this increases the chance of charring the aerosol generating material 44. For example, the operational temperature (that is the temperature at which aerosol is generated from the portion of aerosol generating material 44) may be in the range of between 160° C. to 350° C. Heating a portion of aerosol generating material 44 to above 350° C. may significantly increase the chances of charring which can lead to unpleasant tastes in the aerosol that is subsequently generated. Accordingly, having a heating element 24 with an areal extent of less than 10 $mm^2$ is found to lead to poorer aerosol output.

In some implementations, the surface of the heating element 24 defines an area which is between 30 $mm^2$ to 130 $mm^2$; that is, equal to or greater than 30 $mm^2$ and less than or equal to 130 $mm^2$. In other implementations, the surface of the heating element 24 defines an area which is between 80 $mm^2$ to 130 $mm^2$, 35 $mm^2$ to 80 $mm^2$, or between 40 $mm^2$ to 75 $mm^2$.

The inventors have found that using an aerosol generating material 44 which is an amorphous solid comprising about 20 wt % alginate gelling agent, about 48 wt % Virginia tobacco extract and about 32 wt % glycerol (DWB), and heated to a temperature of around 290° C. using a heating element 24 having an area of between 40 $mm^2$ to 75 $mm^2$, should have a thickness in the range of 0.05 mm to 2 mm to be able to generate a sufficient amount of aerosol in a fairly rapid manner.

Referring back to FIG. 3, FIG. 3 is a cross-sectional, top-down view of the aerosol provision device 2 showing the arrangement of the heating elements 24 in more detail in accordance with the present disclosure. In FIG. 3, six heating elements 24 are shown in an array, and each heating element 24 is depicted as having a circular cross-section. The body of the heating elements 24 themselves may have any shape as necessitated by the specific design of the heating element 24 used, and the body of the heating elements 24 may be provided below the inner surface of the receptacle. However, each heating element 24 at the very least comprises a surface (in this example a circular surface) which is arranged to increase its temperature, e.g., in response to receiving power from the power source 22, and is provided to face into the receptacle 25. It should be appreciated that in other implementations, the area defined by the heating element 24 need not be circular and may have any other desired shape (e.g., rectangular, triangular, hexagonal or square).

The surfaces (e.g., outwardly facing superficial surfaces) of the heating elements 24 have a diameter d. As discussed previously, each portion of aerosol generating material 44 is provided to have a substantially similar areal extent as the surface of the corresponding heating elements 24 such that the heating elements 24 substantially overlap the corresponding portions of aerosol generating material 44. This may avoid the heating elements 24 heating a region of the aerosol generating article 4 that does not contain aerosol generating material 44 (which would otherwise be a waste of energy). Hence the diameter d is substantially the same as the diameter d of FIG. 2, although it should be appreciated in some implementations the diameters may be different.

In the presently described implementations, the surfaces of each of the heating elements 24 have substantially the same area. That is, each of the heating elements 24 has an areal extent that is substantially the same. In the described implementation, each of elements 24*a* to 24*f* have the same diameter d. In this way, each heating element can be operated in substantially the same way and under the same heating conditions to generate a consistent aerosol from each portion of aerosol generating material 44. However, it should be appreciated that in other implementations this may not be the case and the diameters of at least some of the heating elements 24 may vary.

In the example implementation shown, the diameter d of the heating elements 24 may be between 3.6 mm to 12.9 mm (corresponding to an area of between 30 $mm^2$ to 130 $mm^2$). However, in some implementations, the diameter d may be between 7.1 mm and 9.8 mm (corresponding to an area of between around 40 $mm^2$ to around 75 $mm^2$). Further, it is contemplated that other shapes (e.g., rectangular, triangular, hexagonal or square) and/or sizes of heating element may be used having similar dimensions (diameter, width and/or height) corresponding to areas of up to 145 $mm^2$ or up to 170 $mm^2$.

As shown in FIG. 3, the heating elements 24 are separated from one another in the length direction by a separation distance $S_2$ and in the width direction by a separation distance $S_1$. The separation distances $S_1$ and $S_2$ are set such that, when one portion of aerosol generation material 44 is heated by one heating element (e.g., heating element 24*a* and corresponding portion 44*a*), the heat from this heating element 24*a* does not cause a substantial increase in the temperature of an adjacent portion of aerosol generating material, e.g., portions 44*b* and 44*c*. In other words, the separation distances $S_1$ and $S_2$ are arranged such that the adjacent portions of aerosol generating material 44 are not inadvertently heated to an extent that the adjacent portions of aerosol generating material 44 begin generating aerosol. The separation distances $S_1$ and $S_2$ may be influenced by the expected operational temperatures that the heating elements 24 are expected to operate at. Generally, a greater operational temperature will lead to a greater separation distance $S_1$ and $S_2$. The separation distances $S_1$ and $S_2$ may be the same or may differ, however for any given system the separation distances $S_1$ and $S_2$ may share a minimum distance. In this case, the minimum separation distance may be between 1.5 mm to 5 mm.

FIG. 3 also shows the receptacle having a length $l_r$ and a width $w_r$. As should be appreciated form the above, the receptacle should have dimensions sufficiently large to accommodate the plurality of heating elements, and sufficiently small to not increase the overall dimensions of the outer housing 21. The length $l_r$ of the receptacle 25 and the width $w_r$ of the receptacle 25 may vary depending on the application at hand, however the dimensions should be set to ensure that the overall aerosol provision device 2 dimensions do not become significantly larger than a user's palm as mentioned above.

In terms of the parameters d and $S_1$ and $S_2$, the length $l_r$ of the receptacle 25 can be expressed as: $N \times d + N - 1 \times S_2 + B$; while the width $w_r$ of the receptacle 25 can be expressed as: $M \times d + M - 1 \times S_1 + B$, where N is the number of heating elements in the length direction, M is the number of heating elements in the width direction, and B denotes a border of the receptacle 25 (that is the distance surrounding the outer sides of the heating elements 24).

Example 1

Several portions of amorphous solid each comprising about 20 wt % alginate gelling agent, about 48 wt % Virginia tobacco extract and about 32 wt % glycerol (DWB) and having a thickness of 0.1 mm were heated to two different temperatures (230° C. and 290° C.) for a period of 3 seconds using heating elements having circular areas but of different diameters. The heater arrangement used was a ceramic core cartridge heater encapsulated within an aluminum heater block. The heater was supplied with a 24 V voltage to generate a power of 80 W. The ceramic core cartridge had an overall diameter of 6 mm, a length of 20 mm, and a wire length of 100 cm.

The generated aerosol was collected during the 3 second heating period. Amounts of total aerosol collected (aerosol collected matter ACM) per puff, amounts of nicotine per puff and glycerol per puff were obtained at the two different temperatures, as set out in the below table. The collection method was performed using a Cambridge filter pad and associated apparatus as is well-known in the field.

| Heater Diameter (mm) | Heater Temperature (° C.) | Average ACM per puff (mg/puff) | Average Nicotine per puff (mg/puff) | Average Glycerol per puff (mg/puff) |
|---|---|---|---|---|
| 5 | 230 | 0.67 | 0.02 | 0.18 |
| 5 | 290 | 1.45 | 0.05 | 0.40 |
| 7.4 | 230 | 0.84 | 0.02 | 0.22 |
| 7.4 | 290 | 2.50 | 0.07 | 0.65 |

-continued

| Heater Diameter (mm) | Heater Temperature (° C.) | Average ACM per puff (mg/puff) | Average Nicotine per puff (mg/puff) | Average Glycerol per puff (mg/puff) |
|---|---|---|---|---|
| 9.6 | 230 | 1.61 | 0.05 | 0.42 |
| 9.6 | 290 | 3.29 | 0.12 | 1.12 |

As can be seen from the above, the average ACM per puff, average nicotine per puff, and average glycerol per puff generally increases with increasing heater diameter and increasing temperature. Desirable levels of nicotine per puff may be between 0.04 to 0.08 mg/puff when compared to an existing electronic aerosol provision device that heats tobacco, and thus the data above shows that a heater diameter of between 7.4 mm and 9.6 mm when operated at either 230° C. or 290° C. provides a desirable level of nicotine per puff. Additionally, desirable levels of glycerol per puff may be between 0.2 mg/puff to 0.6 mg/puff and thus a heater diameter of between 7.4 mm and 9.6 mm when operated at either 230° C. or 290° C., or a heater diameter of 5 mm when operated at 290° C. provides a desirable amount of glycerol per puff.

It should be appreciated that the data obtained here is merely intended to exemplify a working implementation of the disclosure and is not considered to limit the disclosure. As mentioned several different parameters may also factor into the aerosol that is generated for a given portion of aerosol generating material.

It should be appreciated that although the heating elements 24 are shown as defining a circular cross-sectional area, in other implementations the heating elements 24 may define a square or other polygonal cross-sectional area. For example, in some implementations, the surfaces of the heating elements 24 may define a square having sides of 8 mm by 8 mm.

Figure 5:
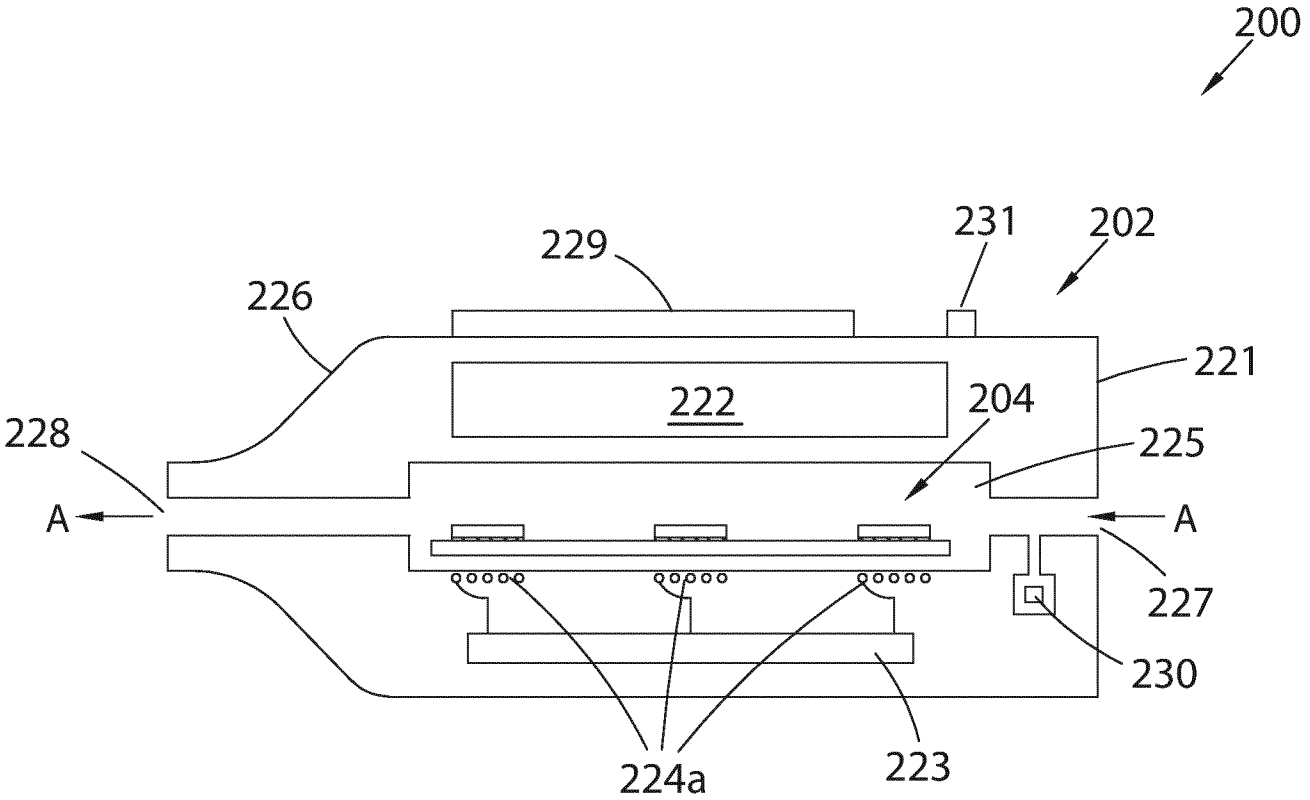
FIG. 5 is a cross-sectional view of a schematic representation of an embodiment of an aerosol provision system comprising an aerosol provision device and an aerosol generating article, the device comprising a plurality of induction work coils and the article comprising a plurality of portions of aerosol generating material and corresponding susceptor portions.

FIG. 5 is a cross-sectional view through a schematic representation of an aerosol provision system 200 in accordance with another embodiment of the disclosure. The aerosol provision system 200 includes components that are broadly similar to those described in relation to FIG. 1; however, the reference numbers have been increased by 200. For efficiency, the components having similar reference numbers should be understood to be broadly the same as their counterparts in FIGS. 1 and 2A to 2C unless otherwise stated.

The aerosol provision device 202 comprises an outer housing 221, a power source 222, control circuitry 223, induction work coils 224*a*, a receptacle 225, an inhalation or a mouthpiece end 226, an air inlet 227, an air outlet 228, a touch-sensitive panel 229, an inhalation sensor 230, and an indicator, e.g. an end of use indicator 231.

Figure 6B:
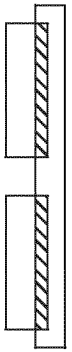
FIG. 6B is an end-on view along the longitudinal (length) axis of the aerosol generating article of FIG. 5.
Figure 6A:
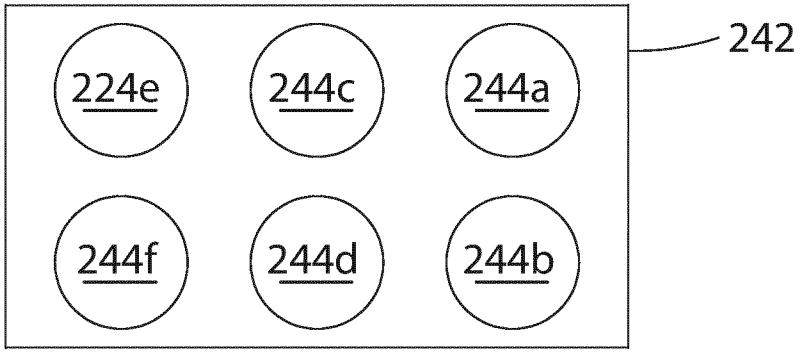
FIG. 6A is a top-down view of the aerosol generating article of FIG. 5.
Figure 6C:
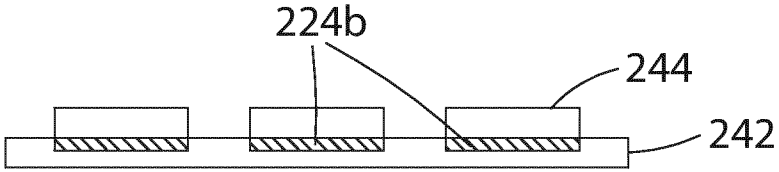
FIG. 6C is a side-on view along the width axis of the aerosol generating article of FIG. 5.

The aerosol generating article 204 comprises a carrier component 242, aerosol generating material 244, and susceptor elements 244*b*, as shown in more detail in FIG. 6A to 6C. FIG. 6A is a top-down view of the aerosol generating article 204, FIG. 6B is an end-on view along the longitudinal (length) axis of the aerosol generating article 204, and FIG. 6C is a side-on view along the width axis of the aerosol generating article 204.

FIGS. 5 and 6 represent an aerosol provision system 200 which uses induction to heat the aerosol generating material 244 to generate an aerosol for inhalation.

In the described implementation, the aerosol generating component 224 is formed of two parts or heating elements; namely, induction work coils 224*a* which are located in the aerosol provision device 202 and susceptors 224*b* which are located in the aerosol generating article 204. Accordingly, in this described implementation, each aerosol generating component 224 comprises elements that are distributed between the aerosol generating article 204 and the aerosol provision device 202.

Induction heating is a process in which an electrically-conductive object, referred to as a susceptor, is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating.

A susceptor is material that is heatable by penetration with a varying magnetic field, such as an alternating magnetic field. The heating material may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The heating material may be both electrically-conductive and magnetic, so that the heating material is heatable by both heating mechanisms.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In this context, either or both of the induction work coils 224*a* and susceptors 224*b* may define an area (e.g., a superficial surface area) that is no greater than 130 $mm^2$, or in some implementations an area of no greater than 145 $mm^2$, or in some further implementations an area of no greater than 170 $mm^2$. In some implementations (not shown) the susceptors 224*b* may be shaped differently (e.g., in size and/or shape) than the induction work coils 224*a*. For example, the susceptor(s) 224*b* may have an areal extent which is larger than the areal extent of the induction work coil(s) 224*a* and the effective area to be heated may be limited by an area of the induction work coil(s) 224*a*. Alternatively, the induction work coils 224*a* may an areal extent larger than the an areal extent of the susceptors 224*b* and the area to be heated may be limited by the area of the susceptors 224*b* alone.

It is also contemplated that a susceptor 224*b* may be arranged to be heated by a plurality (two or more) induction work coils 224*a* which may arranged to heat the same area of the susceptor 224*b*, or may be arranged to heat different areas of the susceptor 224*b*. For example, different regions of a susceptor 224*b* may be arranged adjacent to different induction work coils 224*a*. Thus, a plurality of induction work coils 224*a* may heat a single susceptor 224*b* defining an area that is no greater than 130 $mm^2$, or in some implementations an area of no greater than 145 $mm^2$, or in some further implementations an area of no greater than 170 $mm^2$. Alternatively, a plurality of induction work coils 224*a* each defining an area that is no greater than 130 $mm^2$, or in some implementations an area of no greater than 145 $mm^2$, or in some further implementations an area of no greater than 170 $mm^2$ may be arranged to heat a single susceptor 224*b*.

In the described implementation, the susceptors 224*b* are formed from a metallic foil, e.g., an aluminum foil, although it should be appreciated that other metallic and/or electrically conductive materials may be used in other implementations. As seen in FIG. 6A, the carrier component 242 comprises a number of susceptors 224*b* which correspond in size and location to the discrete portions of aerosol generating material 244 disposed on the surface of the carrier component 242. That is, the susceptors 224*b* have a similar width and length to the discrete portions of aerosol generating material 244.

The susceptors 224*b* are shown embedded in the carrier component 242. However, in other implementations, the susceptors 224*b* may be placed on the surface of the carrier component 242.

The aerosol provision device 202 comprises a plurality of induction work coils 224*a* shown schematically in FIG. 5. The induction work coils 224*a* are shown adjacent the receptacle 225, and are generally flat coils arranged such that the rotational axis about which a given coil is wound extends into the receptacle 225 and is broadly perpendicular to the plane of the carrier component 242 of the aerosol generating article 204. The exact windings are not shown in FIG. 5 and it should be appreciated that any suitable induction coil may be used.

The control circuitry 223 comprises a mechanism to generate an alternating current which is passed to any one or more of the induction work coils 224*a*. The alternating current generates an alternating magnetic field, as described above, which in turn causes the corresponding susceptor(s) 224*b* to heat up. The heat generated by the susceptor(s) 224*b* is transferred to the portions of aerosol generating material 244 accordingly.

As described above in relation to FIGS. 1 and 2A to 2C, the control circuitry 223 is configured to supply current to the work coils 224*a* in response to receiving signaling from the touch sensitive panel 229 and/or the inhalation sensor 230. Any of the techniques for selecting which heating elements 24 are heated by control circuitry 23 as described previously may analogously be applied to selecting which work coils 224*a* are energized (and thus which portions of aerosol generating material 244 are subsequently heated) in response to receiving signaling from the touch sensitive panel 229 and/or the inhalation sensor 230 by control circuitry 223 to generate an aerosol for user inhalation.

Although the above has described an induction heating aerosol provision system where the work coils 224*a* and susceptors 224*b* are distributed between the aerosol provision article 204 and aerosol provision device 202, an induction heating aerosol provision system may be provided where the work coils 224*a* and susceptors 224*b* are located solely within the aerosol provision device 202. For example, with reference to FIG. 5, the susceptors 224*b* may be provided above the induction work coils 224*a* and arranged such that the susceptors 224*b* contact the lower surface of the carrier component 242 (in an analogous way to the aerosol provision system 1 shown in FIG. 1).

Thus, FIG. 5 describes a more concrete implementation where induction heating may be used in an aerosol provision device 202 to generate aerosol for user inhalation to which the techniques described in the present disclosure may be applied.

Although the above has described a system in which an array of aerosol generating components 24 (e.g., heating elements 24) are provided to energize the discrete portions of aerosol generating material 44, in other implementations, the aerosol generating article 4 and/or an aerosol generating component 24 may be configured to move relative to one another. That is, there may be fewer aerosol generating components 24 than discrete portions of aerosol generating material 44 provided on the carrier component 42 of the aerosol generating article 4, such that relative movement of the aerosol generating article 4 and aerosol generating components 24 is required in order to be able to individually energize each of the discrete portions of aerosol generating material 44. For example, a movable heating element 24 may be provided within the receptacle 25 such that the heating element 24 may move relative to the receptacle 25. In this way, the movable heating element 24 can be translated (e.g., in the width and length directions of the carrier component 42) such that the heating element 24 can be aligned with respective ones of the discrete portions of aerosol generating material 44. This approach may reduce the number of carrier components 42 required while still offering a similar user experience.

Although the above has described implementations where discrete, spatially distinct portions of aerosol generating material 44 are deposited on a carrier component 42, it should be appreciated that in other implementations the aerosol generating material 44 may not be provided in discrete, spatially distinct portions but instead be provided as a continuous sheet of aerosol generating material 44. In these implementations, certain regions of the sheet of aerosol generating material 44 may be selectively heated to generate aerosol in broadly the same manner as described above. However, regardless of whether or not the portions are spatially distinct, the present disclosure describes heating (or otherwise aerosoling) portions of aerosol generating material 44. In particular, a region (corresponding to a portion of aerosol generating material 44) may be defined on the continuous sheet of aerosol generating material based on the dimensions of the heating element 24 (or more specifically a surface of the heating element 24 designed to increase in temperature). In this regard, the corresponding area of the heating element 24 when projected onto the sheet of aerosol generating material may be considered to define a region or portion of aerosol generating material 44. In accordance with the present disclosure, each region or portion of aerosol generating material 44 may have a mass no greater than 20 mg, however the total continuous sheet of aerosol generating material may have a mass which is greater than 20 mg.

Although the above has described implementations where the aerosol provision device 2 can be configured or operated using the touch-sensitive panel 29 mounted on the aerosol provision device 2, the aerosol provision device 2 may instead be configured or controlled remotely. For example, the control circuitry 23 may be provided with a corresponding communication circuitry (e.g., Bluetooth) which enables the control circuitry 23 to communicate with a remote device such as a smartphone. Accordingly, the touch-sensitive panel 29 may, in effect, be implemented using an App or the like running on the smartphone. The smartphone may then transmit user inputs or configurations to the control circuitry 23, and the control circuitry 23 may be configured to operate on the basis of the received inputs or configurations.

Although the above has described implementations in which an aerosol is generated by energizing (e.g., heating) aerosol generating material 44 which is subsequently inhaled by a user, it should be appreciated in some implementations that the generated aerosol may be passed through or over an aerosol modifying component to modify one or more properties of the aerosol before being inhaled by a user. For example, the aerosol provision device 2, 202 may comprise an air permeable insert (not shown) which is inserted in the airflow path downstream of the aerosol generating material 44 (for example, the insert may be positioned in the outlet 28). The insert may include a material which alters any one or more of the flavor, temperature, particle size, nicotine concentration, etc. of the aerosol as it passes through the insert before entering the user's mouth. For example, the insert may include tobacco or treated tobacco. Such systems may be referred to as hybrid systems. The insert may include any suitable aerosol modifying material, which may encompass the aerosol generating materials described above.

Although it has been described above that the heating elements 24 are arranged to provide heat to a portion of aerosol generating material 44 at an operational temperature at which aerosol is generated from the portion of aerosol generating material 44, in some implementations, the heating elements 24 are arranged to pre-heat portions of the aerosol generating material 44 to a pre-heat temperature (which is lower than the operational temperature). At the pre-heat temperature, a lower amount or no aerosol is generated when the portion is heated at the pre-heat temperature. However, a lower amount of energy is required to raise the temperature of the aerosol generating material 44 from the pre-heat temperature to the operational temperature. This may be particularly suitable for relatively thicker portions of aerosol generating material 44, e.g., having thicknesses above 400 which require relatively larger amounts of energy to be supplied in order to reach the operational temperature. In such implementations, the energy consumption (e.g., from the power source 22) may be comparably higher, however.

Although the above has described implementations in which the aerosol provision device 2 comprises an end of use indicator 31, it should be appreciated that the end of use indicator 31 may be provided by another device remote from the aerosol provision device 2. For example, in some implementations, the control circuitry 23 of the aerosol provision device 2 may comprise a communication mechanism which allows data transfer between the aerosol provision device 2 and a remote device such as a smartphone or smartwatch, for example. In these implementations, when the control circuitry 23 determines that the aerosol generating article 4 has reached its end of use, the control circuitry 23 is configured to transmit a signal to the remote device, and the remote device is configured to generate the alert signal (e.g., using the display of a smartphone). Other remote devices and other mechanisms for generating the alert signal may be used as described above.

In addition, when the portions of aerosol generating material 44 are provided on a carrier component 42, the portions may, in some implementations, include weakened regions, e.g., through holes or areas of relatively thinner aerosol generating material, in a direction approximately perpendicular to the plane of the carrier component 42. This may be the case when the hottest part of the aerosol generating material 44 is the area directly contacting the carrier component 42 (in other words, in scenarios where the heat is applied primarily to the surface of the aerosol generating material that contacts the carrier component 42). Accordingly, the through holes may provide channels for the generated aerosol to escape and be released to the environment/the air flow through the aerosol provision device 2 rather than causing a potential build-up of aerosol between the carrier component 42 and the aerosol generating material 44. Such build-up of aerosol can reduce the heating efficiency of the aerosol provision system 1 as the build-up of aerosol can, in some implementations, cause a lifting of the aerosol generating material 44 from the carrier component 42 thus decreasing the efficiency of the heat transfer to the aerosol generating material 44. Each portion of aerosol generating material 44 may be provided with one of more weakened regions as appropriate.

Thus, there has been described an aerosol provision device 2 for generating aerosol from an aerosol generating material 441. The aerosol provision device 2 comprises at least one heating element 24 arranged so as to be adjacent aerosol generating material 44 when the aerosol generating material 44 is present in the aerosol provision device 2, wherein the heating element 24 has a surface arranged to increase in temperature when supplied with energy, the surface defining an area of no greater than 130 $mm^2$, or in some implementations an area of no greater than 145 $mm^2$, or in some further implementations an area of no greater than 170 $mm^2$. Accordingly, an aerosol provision device 2 being able to generate sufficient aerosol and being spatially efficient is provided. Also described is an aerosol provision system, and a method for generating aerosol.

While the above described embodiments have in some respects focused on some specific example aerosol provision systems, it will be appreciated the same principles can be applied for aerosol provision systems using other technologies. That is to say, the specific manner in which various aspects of the aerosol provision system function are not directly relevant to the principles underlying the examples described herein.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. An aerosol provision device for generating aerosol from an aerosol generating material, the device comprising:

at least one heating element arranged so as to be adjacent aerosol generating material when the aerosol generating material is present in the aerosol provision device, wherein the heating element has a surface arranged to increase in temperature when supplied with energy, the surface defining an area of no greater than 145 $mm^2$, wherein the surface of the heating element is a circular and planar continuous element, and wherein the surface of the heating element has a diameter of between 7.1 mm to 9.8 mm, wherein the diameter of the heating element and the diameter of the aerosol generating material are substantially the same.

2. The aerosol provision device of claim 1, wherein the surface of the heating element arranged to increase in temperature when supplied with energy defines an area of no less than 10 $mm^2$.

3. The aerosol provision device of claim 1, wherein the surface of the heating element arranged to increase in temperature when supplied with energy defines an area of between 80 to 130 $mm^2$.

4. The aerosol provision device of claim 1, wherein the surface of the heating element arranged to increase in temperature when supplied with energy defines an area of between 40 $mm^2$ to 75 $mm^2$.

5. The aerosol provision device of claim 1, wherein the heating element comprises a coil.

6. The aerosol provision device of claim 1, wherein the heating element comprises a susceptor.

7. The aerosol provision device of claim 1, wherein the device comprises a plurality of heating elements, each heating element having a surface defining an area of no greater than 145 $mm^2$.

8. The aerosol provision device of claim 7, wherein the area defined by the surface of each of the plurality of heating elements is the same.

9. The aerosol provision device of claim 7, wherein the device comprises no more than 20 heating elements.

10. The aerosol provision device of claim 7, wherein each heating element of the plurality of heating elements is spaced apart from the other heating elements of the plurality, and wherein the minimum distance between adjacent heating elements is between 1.5 mm and 5 mm.

11. The aerosol provision device of claim 1, wherein the device is arranged to heat the heating element to a temperature of between 160° C. to 350° C.

12. An aerosol provision system for generating aerosol from an aerosol generating material, the system comprising:

aerosol generating material; and at least one heating element arranged so as to be adjacent aerosol generating material, wherein the heating element has a surface arranged to increase in temperature when supplied with energy, the surface defining an area of no greater than 145 $mm^2$, wherein the surface of the heating element is a circular and planar continuous element, wherein the surface of the heating element has a diameter of between 7.1 mm to 9.8 mm, and wherein the diameter of the heating element and the diameter of the aerosol generating material are substantially the same.

13. The aerosol provision system of claim 12, wherein the surface of the heating element arranged to increase in temperature when supplied with energy defines an area of between 30 $mm^2$ to 80 $mm^2$.

14. The aerosol provision system of claim 12, wherein the aerosol generating material is arranged to have a thickness of between 0.05 mm to 0.4 mm.

15. The aerosol provision system of claim 12, wherein the aerosol generating material is an amorphous solid.

16. A method of generating aerosol from an aerosol generating material, the method comprising:

placing aerosol generating material in proximity of a heating element, and heating the heating element to cause generation of aerosol from the aerosol generating material, wherein the heating element has a surface arranged to increase in temperature when supplied with energy, the surface defining an area of no greater than 145 $mm^2$, wherein the surface of the heating element is a circular and planar element, and wherein the surface of the heating element has a diameter of between 7.1 mm to 9.8 mm, wherein the diameter of the resistive heating element and the diameter of the aerosol generating material are substantially the same.

* * * * *